United States Patent [19]

Weilenmann et al.

[11] Patent Number: 4,478,293

[45] Date of Patent: Oct. 23, 1984

[54] HAMMER DRILL OR CHIPPING HAMMER

[75] Inventors: Walter Weilenmann, Schaanwald; Nikolaus Frick, Schaan, both of Liechtenstein; Peter Hirt, Crans-Pres-Celigny, Switzerland

[73] Assignee: Hilti Aktiengesellschaft, Schaan, Liechtenstein

[21] Appl. No.: 384,411

[22] Filed: Jun. 2, 1982

[30] Foreign Application Priority Data

Jun. 10, 1981 [DE] Fed. Rep. of Germany ..... 3122979

[51] Int. Cl.³ ..... B25D 17/00

[52] U.S. Cl. ..... 173/162 R; 173/162 H; 408/143

[58] Field of Search ..... 173/162 R, 162 H, 139; 408/143; 267/11 A, 136, 137; 188/380, 378, 379

[56] References Cited

U.S. PATENT DOCUMENTS

| | | | |
|---|---|---|---|
| 1,597,245 | 8/1926 | Prellwitz | 173/162 H |
| 1,711,688 | 5/1929 | O'Farrell | 173/162 H |
| 2,152,427 | 3/1939 | Wolf | 267/11 A |
| 2,400,650 | 5/1946 | Leavell et al. | 267/137 |
| 2,875,731 | 3/1959 | Settles et al. | 173/162 R |
| 3,788,804 | 1/1974 | Koudelka et al. | 173/139 |

FOREIGN PATENT DOCUMENTS

| | | | |
|---|---|---|---|
| 247289 | 1/1963 | Australia | 173/162 R |
| 815179 | 8/1951 | Fed. Rep. of Germany | 173/162 |
| 2204160 | 8/1972 | Fed. Rep. of Germany | 173/162 H |
| 2403074 | 7/1975 | Fed. Rep. of Germany | 173/162 H |
| 2237734 | 3/1975 | France | 173/162 R |

*Primary Examiner*—Frank T. Yost
*Assistant Examiner*—Hien H. Phan
*Attorney, Agent, or Firm*—Toren, McGeady and Stanger

[57] ABSTRACT

A hammer drill or chipping hammer includes a housing, a striking mechanism movably displaceably mounted within the housing, and a handle spring supported on the housing. To absorb vibrations generated during operation of the drill or hammer, piston-like weighted members are slidably mounted in the housing for movement parallel to the axial direction of the striking mechanism. The weighted members are supported by springs. Each weighted member is located within a separate cylinder and divides the cylinder into separate spaces. The spaces in the cylinders are interconnected by a fluid medium communicating between them for effecting balanced operation of the weighted members.

6 Claims, 2 Drawing Figures

HAMMER DRILL OR CHIPPING HAMMER

SUMMARY OF THE INVENTION

The present invention is directed to a hammer drill or chipping hammer including a housing, a striking mechanism located within the housing, and a handle connected to the housing.

With hammer drills or chipping hammers, the striking mechanism moves back and forth within the housing and transmits the percussive force to the shank of a drilling or chipping tool. The reciprocating movement or strokes of the striking mechanism develops shock loads in the housing and also generates oscillating or vibrating movements in the housing. Vibrations in the housing are transferred through the handle to the hand or arm of the operator. Such vibrations are not only unpleasant but can eventually lead to physical damage to the operator. In a mechanical pick the operational range usually exceeds the acceptable strain on the operator.

In the past, efforts have been made to reduce the strain experienced by the operator. Accordingly, it has been known to spring support the handle mounted on the housing. For such an arrangement to be effective, it is necessary to use a soft spring. The use of a soft spring, however, results in considerable spring travel. Such a feature is disadvantageous in the manipulation of such manually operated devices.

Further, it is also known to provide an additional spring supported weight or mass in the housing so that it moves in the axial direction of the striking mechanism. The use of such added weight or mass tends to limit vibration. In hammer drills or clipping hammers of the type mentioned above, the vibration acting on the operator has still been found to be too great. Improvements are possible by increasing the added weight, with such an increase, however, the total weight of the device is also increased which, in turn, leads to increased strain on the operator.

Therefore, it is the primary object of the present invention to provide a hammer drill or chipping hammer of limited weight yet which affords considerable ease of operation.

In accordance with the present invention, a hammer drill or chipping hammer is afforded having the following features:

(a) The handle is spring-supported on the housing with the spring action occurring in the same direction as the striking action of the device.

(b) An added weight or mass is spring-supported in the housing with the direction of the spring action being parallel to the direction of the striking action of the device.

The combination of these two known features results in a surprising improvement in the operation of the device and affords a synergistic effect so that the combination provides an operational improvement greater than that attainable through the individual features taken alone. These two features provide an unanticipated effect on one another.

To attain a noticeable effect, the added mass or weight must have a certain minimum size. On the other hand, however, the total weight of the drill or hammer will be directly affected by the added weight, accordingly, for the reasons of operation mentioned above, the increase in weight must not be too great. In practice, it has proven to be advantageous when the weight of the housing amounts to eight to twelve times the added weight. Preferably, the added weight is approximately 10% of the total weight of the hammer drill. Such a weight increase is acceptable without interfering with the operator's comfort. If larger weights are added, the hammer or drill becomes too heavy and can only be handled with considerable difficulty.

Pitching or tilting moments can be avoided within the housing if the added weight or mass is arranged along the percussive axis of the drill or hammer. Such positioning is usually not possible, and the remaining solution is to locate the added weight eccentrically within the housing. To avoid any disturbance from the eccentrically acting forces, it is preferable to divide the added mass into several separate weights each individually supported by springs. Preferably, the individual weights should be arranged symmetrically within the housing. By dividing the added mass into separate weights, there is the further advantage that the individual weights can be of a smaller size and they can be arranged in the housing so that they have less of a disturbing effect than a single additional weight formed of a correspondingly larger size. For reasons of cost, it is preferred to use two separate weights or masses.

If separate weighted members are utilized, there is the possibility that they perform unequal movements. As a result, slight phase displacements may take place between the oscillating movements of the individual weighted members. Such differences could substantially decrease the effect of the added mass during operation of the drill or hammer. To achieve uniform movement of the individual weighted members, they could be mechanically connected to one another. Such a solution, however, is not feasible for reasons of space and economy.

To provide equal movements of the individual weighted members, it is advisable that the members be formed as pistons movably guided within cylinders with the spaces within the cylinders on the opposite sides of the pistons being interconnected by pressure equalization ducts. With the cylinders in communication with one another a fluid medium can flow from one cylinder to the other. The fluid medium can be a liquid or a gas. When the weighted member or piston moves axially within a cylinder there is an increase in pressure on one side of the piston and a partial vacuum is developed on the other side. Pressure equalization within the cylinders takes place by interconnecting a forward space in one cylinder to a rearward space in the other. If one weighted member or piston moves faster than the other, the slower moving one is accelerated by the faster moving one or the faster moving one is slowed down by the slower moving one. In this way the movements of the individual weighted members or pistons are practically the same.

To effect the maximum vibration reduction, it is advantageous if the characteristic frequency of the spring-supported added weight member corresponds substantially to the frequency of the striking mechanism. The characteristic frequency of the added weight member is determined through its size as well as the spring constant of the spring which supports it. When the characteristic frequency of the added weight member is the same as the frequency of the striking mechanism, the weight member vibrates essentially constantly out of phase with the housing. As a result, the shock effect developed in the housing is partially compensated.

The shock effect generated by the striking mechanism acting on the housing can only be partially compensated by the added weight members. To reduce the residual action transmitted from the housing to the handle, it is advisable if the characteristic frequency of the handle is smaller than the frequency of the striking mechanism by a factor of the square root of two. By constructing the drill or hammer in this manner, vibrations are transmitted to the handle in an attenuating form in the range of the striking mechanism frequency. The characteristic frequency of the handle is also determined by its weight as well as by the spring constant of the spring supporting the handle.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
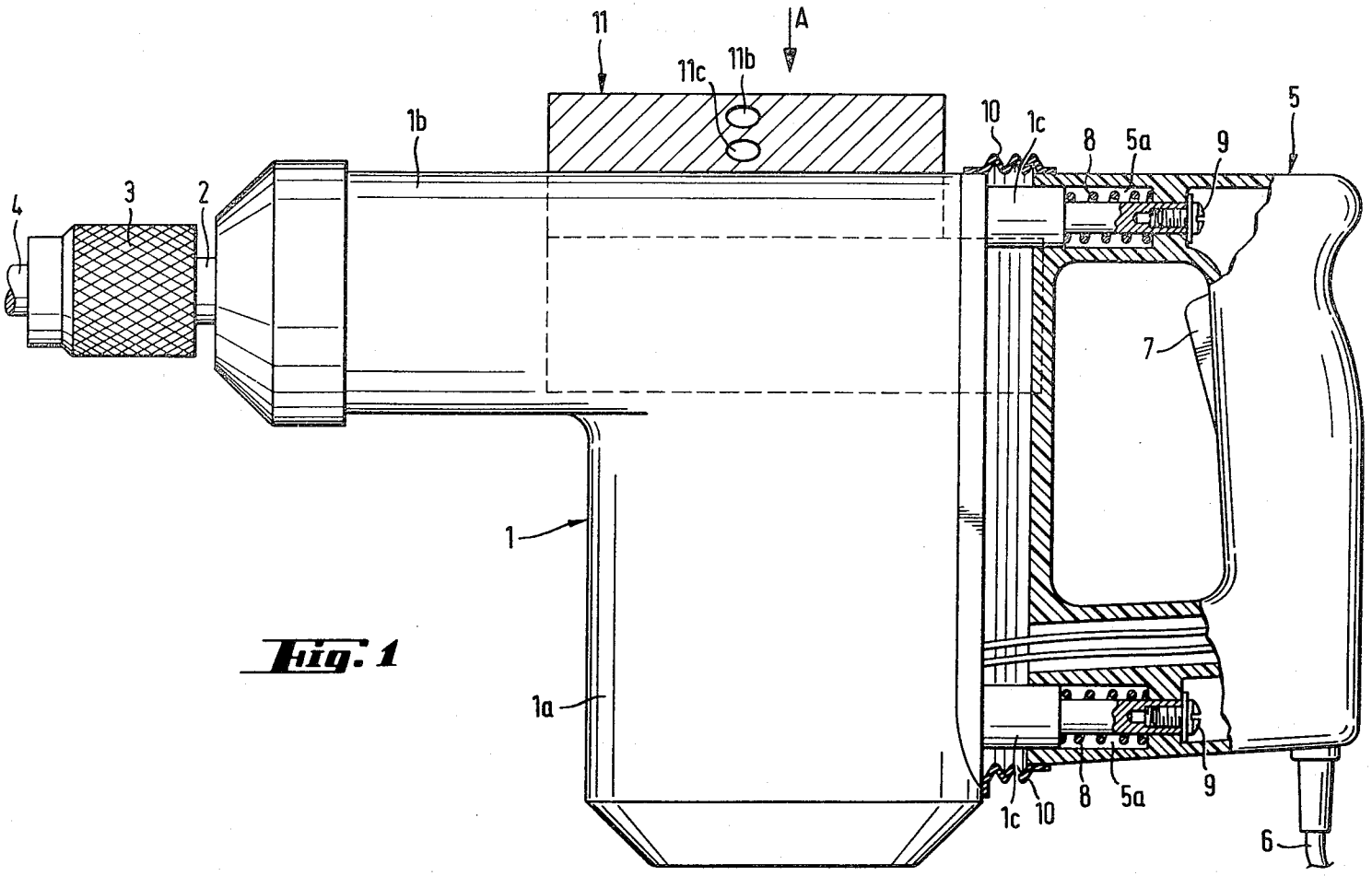
FIG. 1 is a side view, partly in section, of a hammer drill or chipping hammer embodying the present invention.

In the drawing a hammer drill is illustrated including a housing 1. Housing 1 includes a motor part 1*a* depending downwardly from a striking mechanism part 1*b*. As viewed in FIG. 1, the front end of the housing is the left-hand end and the rear end is the right-hand end. The striking mechanism 1*b* reciprocates in the front end-rear direction. At the front end, a spindle 2 projects outwardly from the striking mechanism 1*b* and the spindle supports a chuck 3 into which a tool 4, only partly shown, is secured. A handle 5 is attached to the rear end of the housing. Electric power is supplied to the device through a line 6 connected to the lower side of the handle 5. In addition, a switch 7 is located in the handle for operating the hammer drill. The handle 5 is displaceably mounted relative to the rear end of the housing 1 in the direction of the percussive action of the hammer drill, that is, in the front end-rear end direction corresponding to the axis of the spindle 2. The movement of the handle relative to the housing is effected by an axially extending plug 1*c* fitted into a corresponding borehole 5*a* in the handle. A compression spring 8 is located within the handle and biases the handle in the direction away from the rear end of the housing. Bolt 9 connects the plug 1*c* to the housing and serves as a stop. A gap is present between the rear end of the housing 1 and the adjacent surface of the handle 5 and the gap can be larger or smaller depending on the axial movement or the handle. A bellows 10 secured to the housing and the handle provides a seal around the gap and prevents any penetration of dirt into the hammer drill. Relative movement between the housing 1 and the handle 5 is made possible by the bellows 10. In addition, an absorber housing 11 is positioned on the housing 1, note FIGS. 1 and 2.

Figure 2:
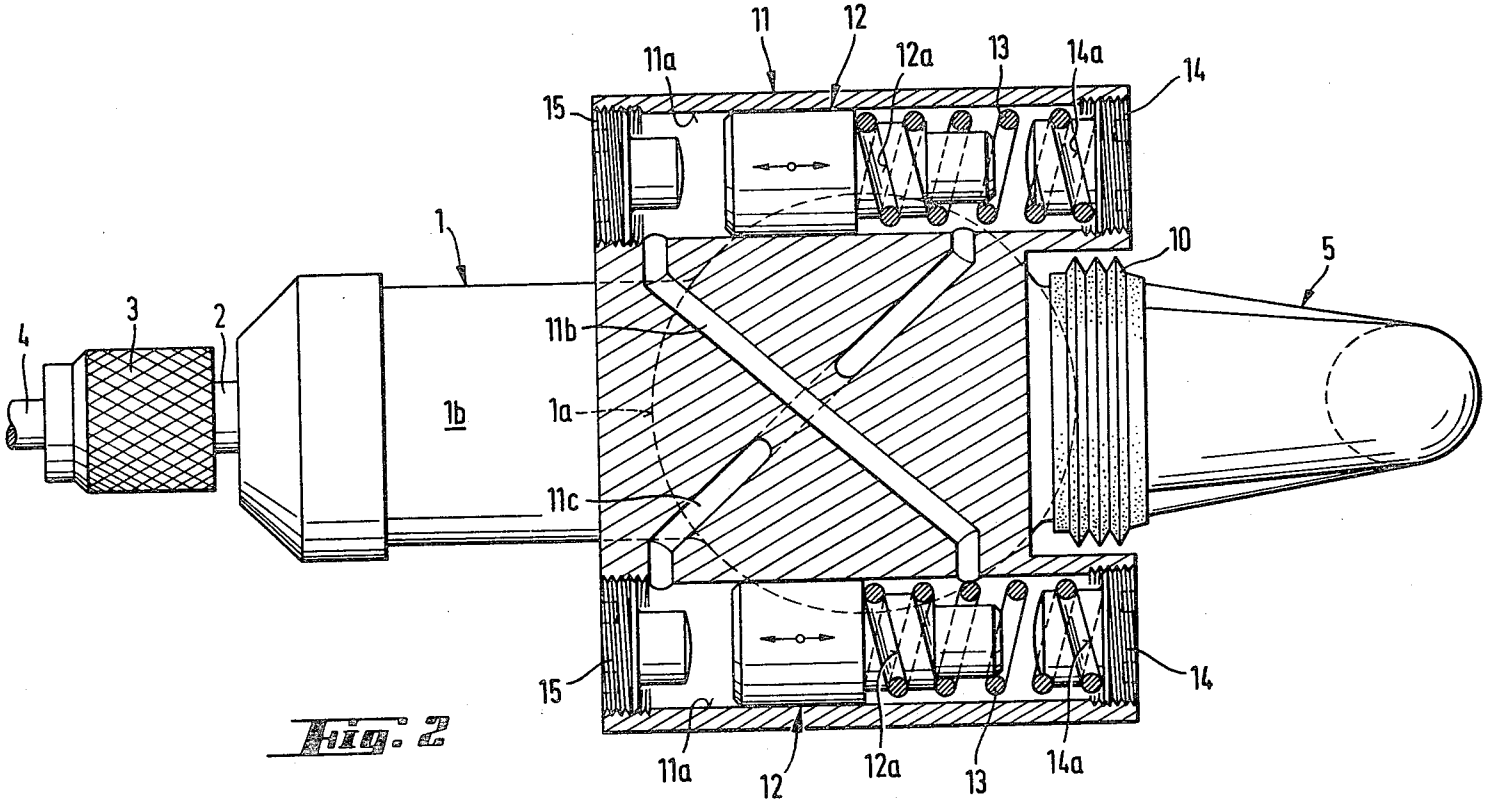
FIG. 2 is a top view of the device illustrated in FIG. 1, partly in section, taken in the direction of the arrow A.

In FIG. 2 the handle 5 can be seen mounted on the rear end of the housing 1 with the bellows 10 sealing the gap between the handle and the housing. At the front end of the housing 1, chuck 3 is shown positioned on the spindle 2 with tool 4 fitted into the chuck. Absorber housing 11 is secured on the housing 1 and has two guide cylinders 11*a* extending parallel to the axis of the striking mechanism, that is the axis extending in the front end-rear end direciton of the housing. The guide cylinders are arranged symmetrically relative to the axis of the striking mechanism 1*b*. A piston-like weighted member 12 is slidably displaceably mounted within each of the guide cylinders 11*a*. Each piston-like weighted member has an axially extending head part at its front end in sliding contact with the inside surface of the guide cylinder 11*a* and an axially extending part with a stepped outside surface, smaller in diameter than the head part, extending axially rearwardly toward the rear end of the guide cylinder. The smaller diameter part of the weighted member has a spring thread 12*a*. A spring 13 is screwed onto the spring thread 12*a* on the piston-like weighted member 12. The other end of spring 13 is connected with an abutment 14 which also has a spring thread 14*a* into which the spring engages. The weighted member 12 is connected to the abutment 14 through the spring 13. In the position of the weighted member 12 shown in FIG. 2, there is a space between the rear end of the weighted member and the front end of the abutment 14. Abutment 14 also serves as a closure for the rear end of the guide cylinder 11*a*. In addition, the front end of the guide cylinder 11*a* is closed by a similar abutment or plug 15. As viewed in FIG. 2, the front end of the head-like part of the weighted member 12 is spaced from the plug 15.

Weighted members 12 and the associated springs 13 form a unit vibrating or oscillating back and forth within the guide cylinders 11*a* parallel to the axis of the striking mechanism 1*b* or of the spindle 2. Since the head-like parts of the weighted members 12 are in sliding contact with the inside surface of the guide cylinders, the interior of the guide cylinders are separated by the head-like part into two spaces. One of the spaces is located ahead of the head-like part while the other space is located behind the head-like part. In the space behind the head-like part the spring 13 and the abutment 14 are located. The space ahead of the head-like part contains the plug 15. Each of these spaces is connected to one of the pressure equalization lines 11*b*, 11*c*. As can be seen in FIG. 2, pressure equalization line 11*b* interconnects the forward space in one guide cylinder 11*a* with the rearward space in the other guide cylinder. Pressure equalization line 11*c* affords the same feature.

As the weighted members 12 move forwardly within the guide cylinders 11*a*, an excess pressure is produced in the forward space while a partial vacuum is developed in the rearward space of each of the guide cylinders. These differences in pressure between the two guide cylinders are compensated via the pressure equalization lines 11*b*, 11*c*. If one of the weighted members 12 moves faster than the other through its guide cylinder 11*a*, then an excess pressure is developed which communicates to the rearward space in the other guide cylinder 11*a* and acts on the other weighted member 12 effecting an acceleration of the slower moving weighted member. Conversely, the faster moving weighted member 12 is slowed down by the intercommunication between the two guide cylinders 11*a*. Accordingly, both of the weighted members 12 move practically in the same manner during operation. If the guide cylinders 7*a* and the pressure equalization lines 11*b*, 11*c* are filled with a liquid instead of a gas, the action of the weighted members 12 can be modified within certain limits. A damping of the vibrations of both weighted members 12 takes place through the flow of the liquid.

The weighted members 12 are dimensioned so that their weight is approximately 10% of that of the housing including the motor and the striking mechanism arranged within it. The characteristic frequency of the weighted members 12 corresponds essentially to the frequency of the striking mechnism. The spring support of the handle is constructed so that the characteristic frequency of the handle is smaller by a factor of approximately the square root of two than the frequency of the striking mechanism. By way of example, at a frequency of 45 Hz for the striking mechanism, the characteristic frequency of the handle amounts to approximately 35 Hz. Such a construction affords an optimum reduction of the vibrations produced by the striking mechanism.

While specific embodiments of the invention have been shown and described in detail to illustrate the application of the inventive principles, it will be understood that the invention may be embodied otherwise without departing from such principles.

We claim:

1. A hammer drill or chipping hammer comprising a housing having a front end and a rear end and an axis extending in the front end-rear end direction, a handle mounted on the rear end of said housing, wherein the improvement comprises means for supporting said handle on the rear end of said housing so that said handle is movably displaceable relative to said housing in the front end-rear end direction, said handle supporting means including first spring, and means for adding weight to said housing and said means for adding weight being movably displaceable in the front end-rear end direction, the weight of said housing is in the range of eight to twelve times that of the weight of said means for adding weight, said means for adding weight comprises a plurality of weighted members and a second spring individually supporting each of said weighted members, said means for adding weight comprises an absorber housing positioned on the outside of said housing and having a front end and a rear end, said absorber housing includes guide cylinders therein extending parallel to the front end-rear end direction of said housing and spaced outwardly from said housing, one said weighted member reciprocates within each of said guide cylinders, each said weighted member being a piston-like member with at least one axially extending part of said piston-like member disposed in sliding contact with the inside surface of said guide cylinder within which it is located, and said absorber housing having pressure equalization lines interconnecting said guide cylinders to equalize pressure created within said guide cylinders as said weighted members reciprocated.

2. A hammer drill or chipping hammer, as set forth in claim 1, wherein said means for supporting said handle comprises a bore formed in said handle, said first spring mounted in said bore and supported at one end against said handle, and a plug slidably fitted into said bore in contact with said first spring and extending from said bore into contact with the rear end of said housing.

3. A hammer drill or chipping hammer, as set forth in claim 2, wherein said handle being spaced in the front end-rear end direction of said housing from said housing and forming a gap therebetween, a bellows secured to said housing and to said handle for forming a closure around the gap between said housing and said handle.

4. A hammer drill or chipping hammer, as set forth in claim 1, wherein said means for adding weight comprises an absorber housing positioned on the outside of said housing and having a front end and rear end, said absorber housing comprises a pair of guide cylinders each extending in the front end-rear end direction of said housing and disposed parallel to and symmetrically of the axis of said housing, said means for adding weight includes a weighted member located within each of said guide cylinders, each of said weighted members being a piston-like member having a head part in axially slidable contact with the inside surface of said guide cylinder and a reduced diameter part extending from said head part in the direction toward the rear end of said housing, and a second spring secured to said reduced diameter part and biasing said weighted member toward the front end of said housing.

5. A hammer drill or chipping hammer, as set forth in claim 4, wherein each said guide cylinder has a front end and a rear end with a plug forming a closure for the front end thereof and an abutment forming a closure of the rear end thereof, and said second spring secured to said weighted member is also secured to said abutment.

6. A hammer drill or chipping hammer, as set forth in claim 5, wherein each said weighted member divides said guide cylinder within which it is located into a front space located ahead of said head-like part and a rear space behind said head-like part, said housing forming a first and second pressure equalization line with said first pressure equalization line connected at one end to the front space in one said guide cylinder and at the other end to the rear space in the other said guide cylinder, and said second pressure equalization line connected at one end to the front space of the other said guide cylinder and at the other end to the rear space of the one said guide cylinder.

* * * * *